US008366561B2

(12) United States Patent
Moosdorf et al.

(10) Patent No.: US 8,366,561 B2
(45) Date of Patent: Feb. 5, 2013

(54) RIDING FLOOR ASSEMBLY

(76) Inventors: Heidi Moosdorf, Ursensollen (DE); Wolfgang Otto, Altdorf (DE); Werner Otto, Altdorf (DE)

( * ) Notice: Subject to any disclaimer, the term of this patent is extended or adjusted under 35 U.S.C. 154(b) by 260 days.

(21) Appl. No.: 12/838,535

(22) Filed: Jul. 19, 2010

(65) Prior Publication Data

US 2011/0014987 A1 Jan. 20, 2011

Related U.S. Application Data

(60) Provisional application No. 61/226,498, filed on Jul. 17, 2009.

(51) Int. Cl.
*A63K 1/00* (2006.01)
*A63K 3/00* (2006.01)

(52) U.S. Cl. ..... 472/86; 472/92; 428/17

(58) Field of Classification Search ..... 472/85–87, 472/90, 92, 94; 428/17, 22, 87, 92, 95; 405/36, 405/43

See application file for complete search history.

(56) References Cited

U.S. PATENT DOCUMENTS

| | | | | |
|---|---|---|---|---|
| 4,648,592 | A * | 3/1987 | Harinishi | 472/92 |
| 4,679,963 | A * | 7/1987 | Heath | 405/36 |
| 6,472,041 | B1 * | 10/2002 | Burke | 428/86 |
| 2006/0154016 | A1 | 7/2006 | Matsuoka | |

FOREIGN PATENT DOCUMENTS

| | | | |
|---|---|---|---|
| DE | 9405829 | U1 | 6/1994 |
| DE | 20019812 | U1 | 4/2002 |
| DE | 202007017767 | U1 | 2/2009 |
| DE | 202008011248 | U1 | 12/2009 |
| JP | 08333708 | A | 12/1996 |
| WO | WO2008028504 | A1 | 3/2008 |

OTHER PUBLICATIONS

German Search Report dated Mar. 3, 2010.

* cited by examiner

*Primary Examiner* — Kien Nguyen
(74) *Attorney, Agent, or Firm* — Laurence A. Greenberg; Werner H. Stemer; Ralph E. Locher

(57) ABSTRACT

A riding floor assembly has a support layer laid on a subfloor. The support layer, or ground preparation layer, is formed of ground preparation elements that are substantially formed of plates and are arranged next to one another. A footing layer covers the upper side of the ground preparation layer. A plurality of tufts of bristles are provided on that side of the ground preparation layer facing toward the footing layer. The tufts of bristles have a length selected such that the bristles do not project out of the footing layer.

22 Claims, 4 Drawing Sheets

RIDING FLOOR ASSEMBLY

CROSS-REFERENCE TO RELATED APPLICATION

This application claims the priority, under 35 U.S.C. §119(e), of provisional patent application No. 61/226,498, filed Jul. 17, 2009; the prior application is herewith incorporated by reference in its entirety.

BACKGROUND OF THE INVENTION

FIELD OF THE INVENTION

The present invention relates to a riding floor, in particular a riding floor which is especially suited for Western riding.

A typical riding floor includes an arrangement which is laid on a subfloor or an underground and comprises ground preparation plates arranged next to one another, and a footing layer on the ground preparation plates. The ground preparation plates serve to provide a stable substructure for the footing layer and to build up a resilient floor that is stable when ridden over. Moreover, it should ensure good water management, that is to say on the one hand store water to prevent the footing layer from drying out, and on the other drain excess water away to prevent the footing layer from becoming too solid or muddy.

Suitable ground preparation plates for constructing riding floors of this kind are disclosed for example in German utility models (Gebrauchsmuster) DE 94 05 829 U1 and DE 200 19 812 U1, or they are known as "perforated mats" that are available from Otto Sport- und Reitplatz GmbH, Altdorf, Germany. A further floor securing plate specifically adapted for use in Western riding floors is described, for example, in German utility model (Gebrauchsmuster) DE 20 2008 011 248 U1, which was published after the priority date of this application.

Depending on the intended purpose (show jumping, dressage, vaulting, Western riding, lungeing and the like), the riding floor must moreover meet various special requirements, in particular as regards shock absorption and surefootedness for the horses. Unlike show jumping and dressage, a riding floor for the various disciplines of Western riding (e.g. reining, cutting, Western riding, etc.) must also ensure that the horses can slide without risk of injury.

SUMMARY OF THE INVENTION

It is accordingly an object of the invention to provide a riding floor, which overcomes a variety of shortcomings and disadvantages of the heretofore-known devices and methods of this general type and which provides for an improved riding floor that is particularly suitable for Western riding.

With the foregoing and other objects in view there is provided, in accordance with the invention, a riding floor assembly, comprising:

a ground preparation layer formed of a plurality of substantially plate-shaped ground preparation elements to be laid next to one another on a subfloor;

a footing layer disposed on the ground preparation elements on an upper side thereof facing away from the subfloor;

a plurality of tufts of bristles disposed on said ground preparation elements on the upper side thereof facing the footing layer, the plurality of tufts of bristles having a length selected such that the bristles do not project out of the footing layer.

In other words, the riding floor assembly, or riding floor for short, according to the invention includes a configuration of ground preparation elements that are laid on a subfloor and that are substantially in the form of plates arranged next to one another, and a footing layer on that side of the configuration of ground preparation elements which is facing away from the subfloor, there being provided on that side of the ground preparation elements facing the footing layer a plurality of tufts of bristles whereof the length is selected such that they do not project out of the footing layer.

The ground preparation elements on the subfloor provide, in a conventional manner, a stable and resilient base for the riding floor. Unlike conventional riding floors, this riding floor is however constructed with ground preparation elements, on the side whereof that faces the footing layer a respective plurality of tufts of bristles is provided which do not project above the footing layer. The result of providing the tufts of bristles is that the riding floor allows the horses to slide, as is demanded in the various disciplines of Western riding, without risk of injury to the horses.

The tufts of bristles may be provided in a variety of ways on that side of the ground preparation elements that faces the footing layer.

In this context, it is to be noted that the ground preparation elements provided with a plurality of tufts of bristles according to the present invention are to be distinguished from artificial lawns such as those shown, for example, in patent application publication U.S. 2006/0154016 A1. Those neither provide for elasticity and surefootedness, nor are they to be covered with a footing layer made of sand.

In accordance with a further feature of the invention, the upper side of the ground preparation elements, which faces the footing layer, is constructed in each case to have a plurality of recesses or voids formed therein. A depth of the recesses is smaller than a total length of the tufts of bristles and the tufts of bristles are partly accommodated in the recesses. It is thus relatively simple to produce the ground preparation elements, which may be in the form of plates, with the tufts of bristles.

In this embodiment, the tufts of bristles may for example be inserted, clamped, pressed, driven, glued and/or welded into the recesses in the ground preparation elements.

The depth of the recesses, by way of example, lies within the range of approximately 20-70%, more preferably approximately 30-50%, of the height of the ground preparation elements. According to another approach, the depth of the recesses in the ground preparation elements is for example approximately 100-300%, more preferably approximately 150-250%, most preferably approximately twice the diameter of a tuft of bristles. This results in a sufficiently stable securing of the tufts of bristles to the ground preparation elements with simple production methods.

In another embodiment, the ground preparation elements are each constructed with a plurality of apertures through which the tufts of bristles are guided such that they project out of the ground preparation elements on the upper side of the ground preparation elements, which faces the footing layer.

In this embodiment, the tufts of bristles may, for example, project out of the ground preparation elements on the underside thereof, facing the subfloor, and be fixed there.

In yet another embodiment, at least one mat element which contains a plurality of tufts of bristles may be arranged on the side of the ground preparation elements facing the footing layer. In this embodiment, conventional ground preparation elements may, for example, be used and combined with the mat elements to form a riding floor according to the invention.

In a further embodiment of the invention, the ground preparation elements may each be constructed with a plurality of open apertures in their thickness direction. Whereas the upper side of the ground preparation elements serves to store liquid in the footing layer, the open apertures ensure that excess water drains away from the surface of the riding floor.

In accordance with a further preferred embodiment of the invention, a water guidance layer may be provided between the configuration of ground preparation elements and the footing layer. This water guidance layer is intended to have the effect of evenly distributing water to the upper side of the ground preparation elements, both for the purpose of storing moisture and for the purpose of draining away excess water.

The height of the water guidance layer preferably corresponds at most to the length of the tufts of bristles projecting out of the ground preparation elements. Moreover, the height of the water guidance layer may, for example, be at least one third, more preferably at least half, of the length of the tufts of bristles projecting out of the ground preparation elements.

Furthermore, the water guidance layer is formed between the configuration of ground preparation elements and the footing layer, for example from a coarse-particle sand, gravel, grit or similar material.

In a further embodiment of the invention, it is possible also to provide a water-guiding support layer between the subfloor and the configuration of ground preparation elements, which is formed for example from gravel, grit or similar material. This water-guiding support layer may help to drain away excess water from the riding floor.

The footing layer of the riding floor may for example be formed from fine-particle sand or similar material.

Further, the ground preparation elements of the configuration of ground preparation elements which are arranged next to one another may each be connected to one another in the manner of a tongue-and-groove system (in particular loosely). The tongue-and-groove system is in this case preferably constructed to be integral with each of the ground preparation elements. In this way, the adjacent ground preparation elements may mutually keep each other in position as a composite structure and prevent a ground preparation element from being pivoted up or set upright.

This tongue-and-groove system may for example include first and second extensions which are provided at the lateral periphery of the ground preparation elements (in other words, at the side edges thereof) and extend laterally, with the heights of the first and second extensions in each case being smaller than the height of the ground preparation elements, and the first and second extensions being arranged and/or constructed along the periphery and in the vertical direction of the ground preparation elements such that in the case of two mutually adjacent ground preparation elements at least one first extension of the one ground preparation element and at least one second extension of the other ground preparation element overlap one another in the vertical direction of the ground preparation elements.

In yet another embodiment of the invention, in each case at least one projection may be provided on the underside of the ground preparation elements, which faces the subfloor. This at least one projection may advantageously serve as a means of anchoring the ground preparation elements in the subfloor (depending on the type of subfloor) and/or as a point of action for ejectors in the process of manufacturing the ground preparation elements.

This at least one projection is preferably constructed to be integral with the ground preparation element.

Moreover, a plurality of web-like projections is preferably provided. These may for example be arranged in the form of a plurality of parallel rows or intersecting rows.

The ground preparation elements may for example be made from a synthetic material such as PVC. Advantageously, in this case recycled materials (for example cable insulation elements) may be used.

According to a further embodiment of the invention, the riding floor according to the invention may also be combined with a so-called ebb-and-flow system to provide the optimum degree of moisture of the riding floor in a manner that saves water as much as possible.

To this end, the riding floor may be provided with at least one drainage device on the side of the ground preparation elements which faces the subfloor. This at least one drainage device is preferably connected to a water compensation device that is arranged laterally outside the riding floor and is formed from a water-receiving chamber provided with a water inlet and/or a water outlet. Moreover, the riding floor may be constructed in a watertight basin.

Other features which are considered as characteristic for the invention are set forth in the appended claims.

Although the invention is illustrated and described herein as embodied in a riding floor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
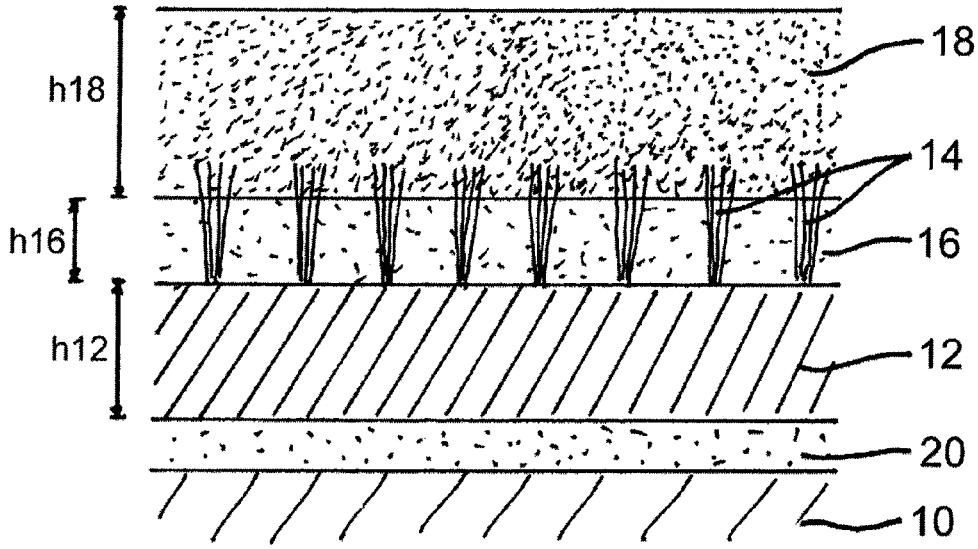
FIG. 1 shows a diagrammatic partial sectional view of a riding floor according to the present invention.

Referring now to the figures of the drawing in detail, the basic structure of the riding floor assembly according to the invention will now be described with reference to FIGS. 1 and 5.

In principle, the riding floor may be built up on any subfloor 10. Depending on the subfloor 10, first of all a water-guiding support layer 20 may be positioned thereon. The support layer 20 is for example formed from gravel, gravel sand, grit or similar material.

Then, on this support layer 20 or, where appropriate directly on the subfloor 10, there is laid a configuration of ground preparation elements 12 next to one another. The configuration of ground preparation elements 12 is also referred to as a ground preparation layer. The ground preparation elements 12 are substantially in the form of plates, that is to say their length l12 and width b12 (cf. FIG. 5) are markedly greater than their thickness or height h12 (top-to-bottom, in FIG. 1). The ground preparation elements 12 shown here are preferably rectangular or square. It will be understood that this is only exemplary and not restrictive.

The ground preparation elements 12, by way of example, have a length l12 of approximately 1.0 to 1.2 m (~4 ft) and a width of approximately 0.7 to 0.9 m (~3 ft), with the result that, in the example, each plate covers an area of approximately 1 $m^2$ (~11 $ft^2$). The thickness or height h12 of the ground preparation elements 12, by way of example, lies in the range of approximately 1 to 6 cm, more preferably approximately 2 to 4 cm (0.8-1.6 in). It goes without saying, however, that the riding floor assembly of the invention is not restricted to these dimensions of the ground preparation elements.

The material of the ground preparation elements 12 is preferably a synthetic material such as PVC or unplasticized PVC. When the ground preparation elements 12 are manufactured, recycled materials (for example, cable waste) may also preferably be used. This choice of material affords the ground preparation elements 12 a certain intrinsic resilience or spring effect, which provides the horses with a surface which is stable to ride over and is at the same time gentle on the horses' joints. The ground preparation elements 12 are, for example, made by injection molding technology.

As indicated in FIG. 1, a plurality of tufts of bristles 14 is provided on the side of the ground preparation elements 12 remote from the subfloor 10 (the top in FIG. 1). Various possibilities for providing these tufts of bristles will be described in more detail below with reference to FIGS. 2 to 4.

Figure 5:
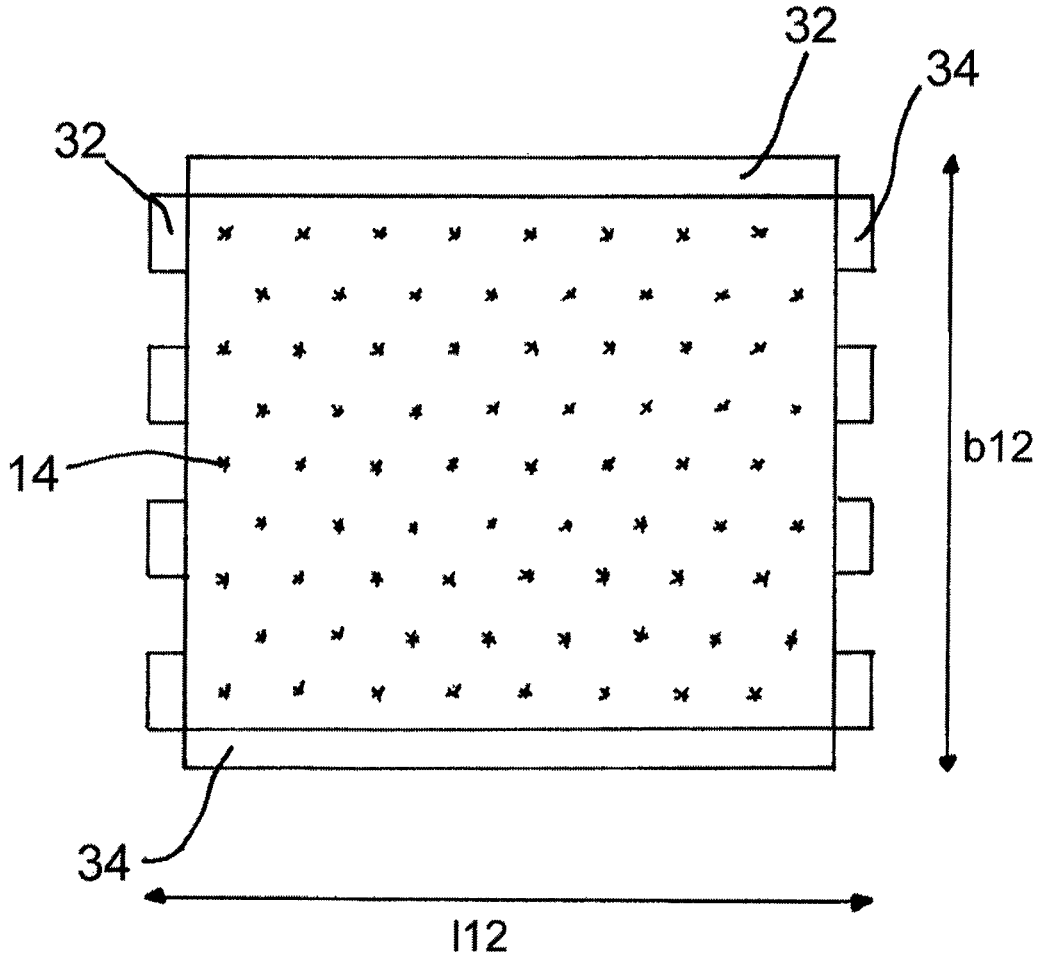
FIG. 5 shows a diagrammatic detail plan view of a flooring securing element of the riding floor from FIG. 1.

As can be seen in the highly diagrammatic plan view of FIG. 5, the tufts of bristles 14 are distributed strategically about the ground preparation layer and, as here, as evenly as possible over the riding floor or the ground preparation elements 12.

With an arrangement in the manner of a matrix, the grid size of the tufts of bristles 14 is for example approximately 1 to 3 cm, more preferably approximately 1.5 to 2 cm. The larger the grid size selected, the softer the riding floor, and the smaller the grid size, the harder the riding floor.

The grid size of the tufts of bristles 14 may be selected to be the same in the directions of length and breadth of the ground preparation elements 12, or—as indicated by way of example in FIG. 5—may also be different. For example, the tufts of bristles 14 may be distributed in a regular pattern, an irregular pattern or indeed in a disordered manner over the ground preparation elements 12.

Commercially available tufts of bristles 14 may for example be used, but it is also possible for specially adapted bristles or tufts of bristles to be used. A tuft of bristles 14 comprises for example 4 to 12, more preferably 6 to 10, upwardly projecting bristles. When a tuft of bristles 14 of this kind is manufactured, for example half this number of bristles is taken and bent approximately in the middle, this bent middle then being on the side facing the ground preparation elements 12. In addition or as an alternative, the individual bristles of a tuft of bristles 14 may also be held together by a ring or similar. In this way, a stable composite structure of bristles for the tuft of bristles 14 is attained.

A tuft of bristles 14 has for example a diameter d14 (parallel to the plane of the ground preparation elements 12) of in the region of approximately 0.3 to 1.5 cm, more preferably approximately 0.5 to 1.0 cm.

The bristles of the tufts of bristles 14 are preferably made from a relatively hard synthetic material such as PVC or PE. As an alternative for the tufts of bristles 14, it is however also possible to use other materials such as wire or natural materials such as coconut fibers. The (fiber) thickness of the individual bristles of the tufts of bristles is for example approximately 1 to 3 mm, more preferably approximately 1.2 to 2 mm, most preferably approximately 1.5 mm.

On the upper side of the ground preparation elements 12 with the tufts of bristles 14 there is first placed a water-guiding layer 16 before, finally, a footing layer 18 of the riding floor is formed.

The water-guiding layer 16, between the arrangement of ground preparation elements 12 and the footing layer 18, is preferably formed from a coarse-particle sand, gravel, grit or similar material. For example, for the water-guiding layer 16 a coarse quartz sand is used, for example having a particle size of 0-3 mm. This coarse particle size of the water-guiding layer 16 is advantageous to ensure water permeability and to prevent water drainage holes 24 which are preferably provided in the ground preparation elements 12 (described below) from becoming clogged.

The height h16 of the water-guiding layer 16 should on the one hand correspond at most to the height h14 of the tufts of bristles 14 projecting out of the ground preparation elements 12 and on the other hand preferably be at least one third, more preferably at least half, of the length h14 of the tufts of bristles 14 projecting out of the ground preparation elements 12. In one embodiment, the length h14 of the tufts of bristles 14 projecting out of the ground preparation elements 12 is in the region of approximately 1 to 5 cm, more preferably in the region of approximately 2 to 4 cm, most preferably approximately 3 cm.

This water-guiding layer 16 serves to distribute the water evenly to the ground preparation elements 12.

The footing layer 18 on the water-guiding layer 16 is preferably formed from fine-particle sand or similar material. The term "fine-particle sand" should be understood to mean, for example, a fine sand of quartz or granite, preferably having a particle size of 0-1 mm. The fine-particle footing layer 18 provides a firm floor surface for the horses.

The thickness of the footing layer 18 is for example in the region of approximately 2 to 8 cm, more preferably approximately 3 to 4 cm.

To attain a footing layer 18 which is adapted in an optimum manner, that is to say to create the correct consistency (resilience, depth of hoof indentation in the sand, and similar), additional components are usually added to the chosen sands. In a known variant, this additional component to produce the footing layer 18 is so-called geotextile, which comprises synthetic fiber. The functions of this additional component are on the one hand to absorb water and to return it to the footing layer, in order to retain the moisture thereof for longer, and on the other for the nonwovens to increase the resilience of the sand and to make it possible to regulate the consistency of the footing layer 18.

In particular for Western riding, additional materials of this kind may also advantageously be omitted from the footing layer 18 of the riding floor according to the invention.

Figure 2:
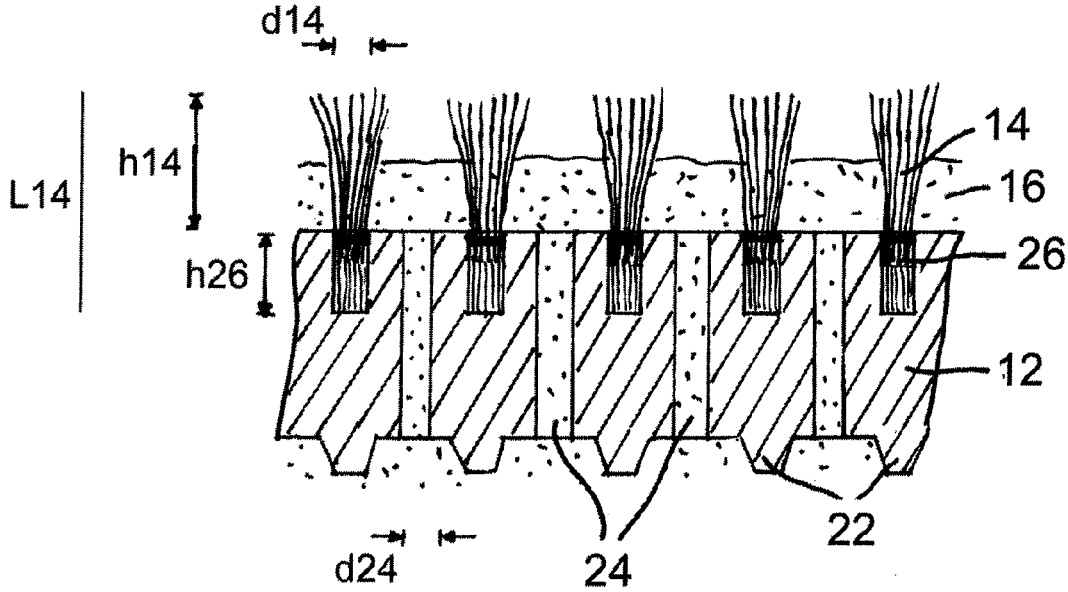
FIG. 2 shows a diagrammatic detail sectional view of the ground preparation element in FIG. 1, according to a first embodiment of the invention.
Figure 3:
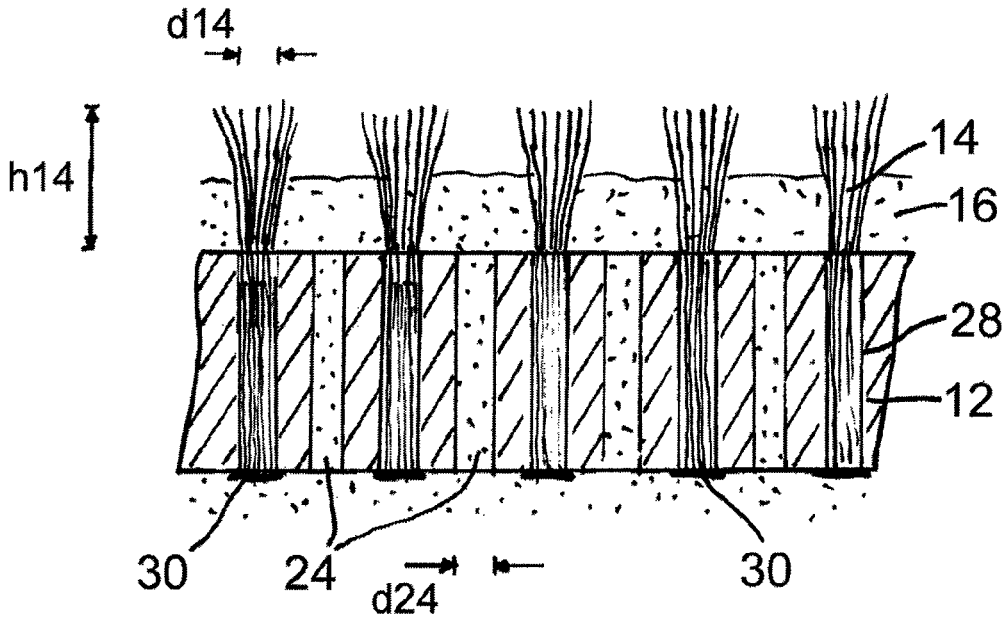
FIG. 3 shows a diagrammatic detail sectional view of the ground preparation element in FIG. 1, according to a second embodiment of the invention.
Figure 4:
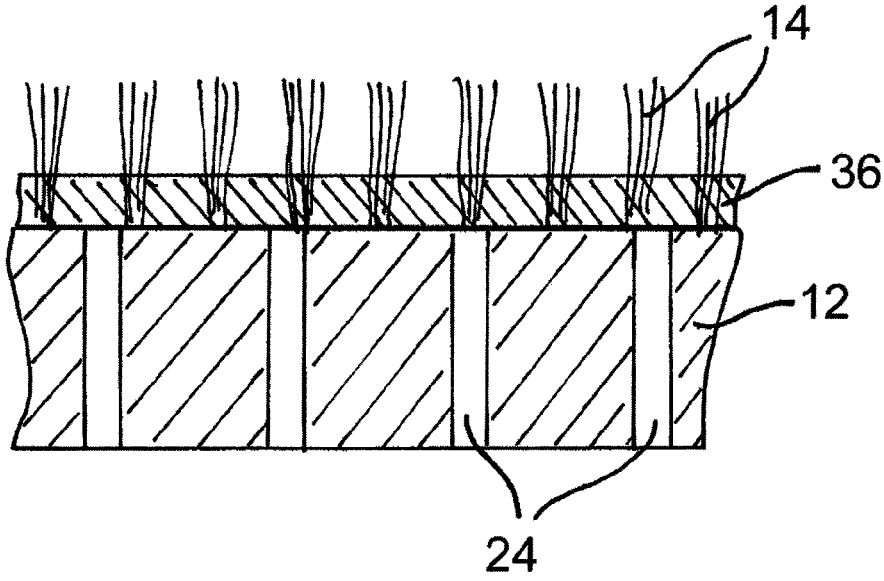
FIG. 4 shows a diagrammatic detail sectional view of the ground preparation element in FIG. 1, according to a third embodiment of the invention.

With reference to FIGS. 2 to 4, various possibilities for providing the tufts of bristles 14 for the riding floor of the invention will now be described in more detail.

According to the first embodiment, in FIG. 2, the tufts of bristles 14 are secured to the upper side (at the top in FIGS. 1 and 2) of the ground preparation elements 12. To this end, a respective plurality of recesses 26 (corresponding to the number of tufts of bristles to be attached) is made in the upper side of the ground preparation elements 12. The tufts of bristles 14 are inserted, clamped, pressed or driven into these recesses 26. In addition, the tufts of bristles 14 may also be glued or welded.

If the individual tufts of bristles 14 are held together by a ring, wire or similar, the latter exerts an additional pressing or wedging action in the respective recess 26.

It goes without saying that the depth d26 of the recesses 26 is selected to be smaller than the overall length L14 of the tufts of bristles 14. Preferably, the depth d26 of the recesses 26 is in the region of approximately 20-70%, more preferably approximately 30-50%, most preferably approximately 40%, of the thickness or height h12 of the ground preparation elements 12. According to another approach, the depth d26 of the recesses is selected to be approximately 100-300%, more preferably 150-250%, most preferably approximately 200%, of the diameter d14 of a tuft of bristles 14.

In an exemplary embodiment, the height h12 of the ground preparation elements 12 is approximately 2.5 cm, the diameter d14 of the tufts of bristles 14 is approximately 0.5 cm, the overall length L14 of the tufts of bristles is approximately 3.5 cm, the length h14 of the tufts of bristles projecting out of the ground preparation elements 12 is approximately 2.5 cm and the depth d26 of the recesses 26 is approximately 1 cm.

Instead of the recesses 26, as an alternative, bores into which the tufts of bristles 14 are correspondingly only partly inserted may also be provided in the ground preparation elements 12.

It is also shown in FIG. 2 that the ground preparation elements 12 are preferably (although not necessarily in all applications) also provided with a plurality of (open) apertures or through bores 24 which extend through the entire thickness of the ground preparation elements 12. Water can drain from the upper side of the ground preparation elements 12 through these apertures 24 such that excess water can be drained away from the riding floor in a simple manner.

The apertures 24 preferably each have the outline shape of a circle, which makes them particularly simple to manufacture. The diameter of an aperture 24 of this kind is for example approximately 4 to 5 mm. However, other outline shapes are also possible for the apertures 24, such as squares, rectangles, polygons, ellipses and similar.

As indicated in FIG. 2, a respective plurality of projections 22 is provided on the underside, that is on the side of the ground preparation elements 12 facing the subfloor 10. These projections 22 are for example in the form of webs and run, parallel to one another and/or intersecting one another, beyond a ground preparation element 12. The spacing between the individual webs may for example be approximately 3 to 10 cm, more preferably approximately 4 to 7 cm. The height of the projections 22 (in the vertical direction of the ground preparation elements 12) is for example approximately 0.5 to 2 cm, more preferably approximately 1.0 cm.

The projections 22 are preferably integrally formed with the ground preparation elements 12. For the purpose of simpler manufacture, the projections 22 are for example each conical in shape, as indicated in FIG. 2, to simplify removal from the injection mold.

These projections 22 moreover serve to anchor the ground preparation elements 12 to the subfloor 10 and/or the water-guiding support layer 20. On the other hand, they keep the subfloor and/or support layer material away from the apertures 24 so that the latter do not become clogged and in this way drainage of excess water away through the apertures 24 is maintained in a guaranteed manner.

An alternative way of securing the tufts of bristles 14 to the ground preparation elements 12 is illustrated in FIG. 3. Here, the ground preparation element 12 is constructed to have—in addition to the plurality of open apertures 24—a plurality of (further) apertures 28 which extend through the ground preparation element 12 in the vertical direction thereof. The tufts of bristles 14 are in this case selected to be sufficiently long to project on the one hand upward out of the ground preparation element 12 in the direction of the footing layer 18, and on the other through the entire aperture 28.

The tufts of bristles 14 preferably project somewhat on the underside of the ground preparation elements 12, the side facing the subfloor 10, and are fixed there 30 for example by gluing, welding, clamping or similar measures such that they are prevented from slipping out of the apertures 28.

Although FIG. 3 does not show it, projections 22 may also be provided on the underside of the ground preparation elements 12 in the embodiment of FIG. 3.

The statements made above in connection with FIG. 2 on the individual tufts of bristles 14 also apply accordingly to this embodiment of the ground preparation elements.

In yet another possible embodiment, the tufts of bristles 14 are not directly secured to the ground preparation elements 12. As shown in FIG. 4, a mat element 36 is arranged on the side of the ground preparation elements 12 facing the footing layer 18 (at the top in FIG. 4). This mat element 36 for its part contains the plurality of tufts of bristles 14, which project out of it in the direction of the footing layer (at the top in FIG. 4).

The mat element 36 may optionally be laid on the ground preparation elements 12 or be fixedly connected (e.g. glued) thereto. The mat elements 36 may optionally have substantially the same dimensions (length and breadth) as the ground preparation elements 12, or be different from these. The thickness or height of the mat elements 36 is preferably selected to be smaller than that of the ground preparation elements 12, and is for example only approximately 1 to 1.5 cm (in addition to the length h14 of the tufts of bristles 14 projecting out).

The formation of a composite structure of ground preparation elements of the riding floor lying next to one another will now be explained with reference to FIGS. 5 to 7.

As already mentioned, the ground preparation elements 12 are laid next to one another in the riding floor. To attain as stable a composite structure as possible, the adjacent ground preparation elements 12 are preferably connected to one another by an interlocking tongue-and-groove system 32, 34. The tongue-and-groove system of the ground preparation elements 12 includes for example first extensions 32 and second extensions 34 which extend outward from the side margins of the ground preparation elements, as indicated in FIG. 5.

In the exemplary embodiment in FIG. 5, two first extensions 32 are constructed on two mutually adjoining side margins, and two second extensions 34 are constructed on two further mutually adjoining side margins of the ground preparation element 12. However, the invention is not restricted only to this embodiment. For example, it is also possible for one or more first and second extensions 32, 34 to be provided alternately on one side margin. Moreover, the first and second extensions 32, 34 need not necessarily extend around the entire periphery of the ground preparation element 12, as is already illustrated in FIG. 5.

The heights of the first and second extensions 32, 34 are in each case markedly smaller than the overall height h12 of the ground preparation element 12. In a first exemplary embodiment of FIG. 6, the heights of these extensions 32, 34 are each approximately half the height h12 of the ground preparation element 12. In this case, for example, the first extensions 32 are constructed to adjoin and be flush with the underside of the ground preparation element 12, and the second extensions 34 are constructed to adjoin and be flush with the upper side of the ground preparation element 12.

Figure 7:
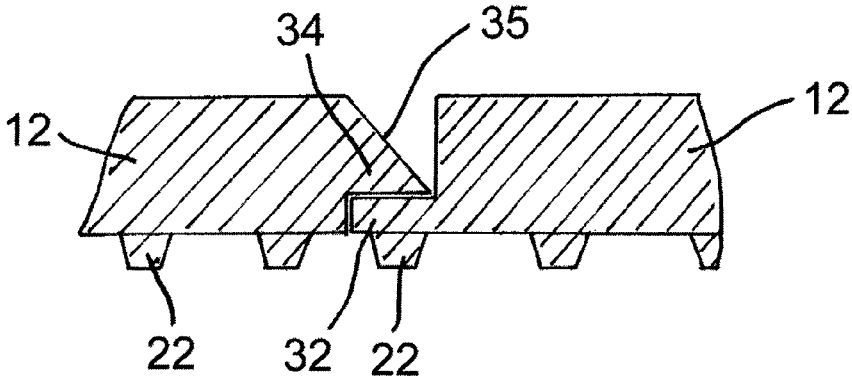
FIG. 7 shows a diagrammatic detail side view of a connection between ground preparation elements in FIG. 5, according to a second embodiment.

In a second exemplary embodiment (cf. FIG. 7) the second extensions 34 of the ground preparation elements 12, which are on the side facing the footing layer 18, are constructed to have an oblique or cone-like face 35, as illustrated in FIG. 7. When the adjacent ground preparation elements 12 are displaced mutually laterally, it is advantageously possible in this way to prevent the material of the water-guiding layer 16 and/or the footing layer 18 from collecting in the interstitial space between the adjacent ground preparation elements 12 and preventing them from moving closer together. Instead, material which falls down when the ground preparation elements 12 slide apart is pushed upward again by the oblique face 35 of the second extension, such that the two ground preparation elements 12 can move right up to one another again.

Moreover, FIG. 7 indicates that the heights of the first and second extensions 32, 34 need not necessarily be substantially the same. In particular, it is preferable for the height of the second extensions 34 to be greater than the height of the first extensions 32. In an embodiment, for example the height h12 of the ground preparation element 12 is approximately 2.5 cm, the height of the second extensions 34 is approximately 2 cm and the height of the first extensions 32 is approximately 0.5 cm.

Furthermore, it is preferably provided for a projection 22 also to be provided on the underside of the ground preparation element 12 in the region of the first extensions 32, in order to give the tongue-and-groove system 32, 34 greater stability.

Figure 6:
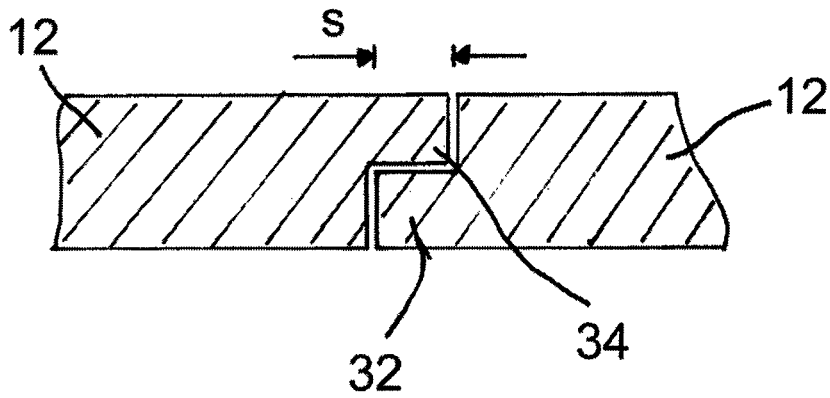
FIG. 6 shows a diagrammatic detail side view of a connection between ground preparation elements in FIG. 5, according to a first embodiment.

As can be seen from FIGS. 6 and 7, the first and the second extensions 32, 34 are dimensioned and arranged on the securing element 12 such that, in a composite structure of securing elements 12 arranged next to one another, a respective first extension 32 of a securing element 12 at least partly overlaps a second extension 34 of an adjacent securing element 12. In this way, the ground preparation elements 12 are firmly held in their vertical position with respect to one another in the composite structure of the riding floor and so form a firm riding floor. In particular, the possibility that individual ground preparation elements 12 may be set upright on their margins, and so present a risk of injury to the horses, is prevented.

The extent of mutual overlap s is for example approximately 3 to 8 cm, more preferably approximately 4 to 5 cm.

Furthermore, the undersides of the second extensions 34 and the upper sides of the first extensions 32, that is to say their mutually facing sides of adjacent ground preparation elements 12, are preferably each constructed to be substantially flat or smooth. This enables the ground preparation elements 12 to slip in respect of one another in the plane in which they are laid. This improves the properties of the riding floor especially for Western riding, since in that case the horses frequently slide on the riding floor.

The entire ground preparation element 12 of the riding floor according to the invention is preferably integrally formed, that is to say for example is injection molded or press molded and stamped as one part. In particular, the projections 22 and the tongue-and-groove system 32, 34 are also integrally formed with the ground preparation element 12.

The features of the tongue-and-groove systems of the two embodiments in FIGS. 6 and 7 may moreover be combined with one another in any desired way.

It will be explained below with reference to FIG. 8 how the riding floor according to the invention may be combined with a so-called ebb-and-flow system to provide the optimum degree of moisture of the riding floor in a manner that saves water as much as possible.

The combination of a riding floor with integral ground preparation elements and ebb-and-flow system is known for example from patent application publication U.S. 2010/0040420 A1 (application Ser. No. 11/816,942) and its counterpart international patent application publication WO 2008/028504 A1, the contents of which is herewith incorporated by reference in their entirety.

Figure 8:
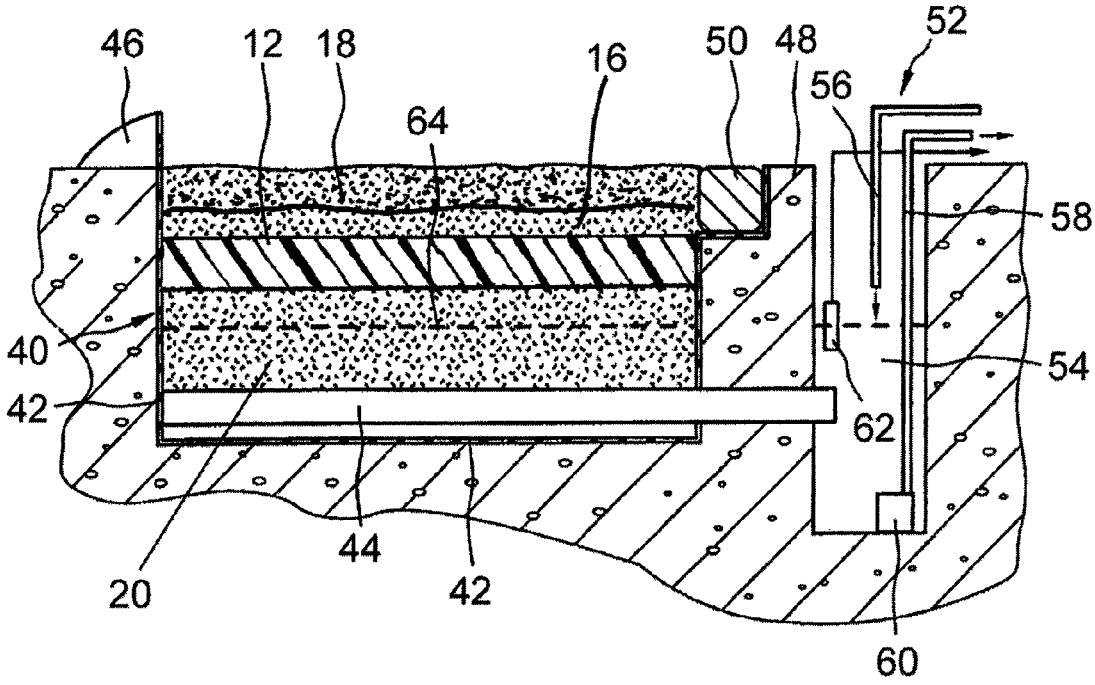
FIG. 8 shows a diagrammatic sectional view of a riding floor securing and watering arrangement, according to a preferred embodiment of the present invention.

As FIG. 8 shows in a highly simplified illustration, the riding floor described above is constructed in a watertight basin 40. This basin is for example formed from a depression in the floor 10, which is lined with a watertight film 42 to make the basin 40 watertight. The usable area serving as the riding floor may furthermore be delimited by an earth wall 46 and/or with sills 50.

At least one drainage device 44, for example in the form of a plurality of drainage tubes, is disposed in the base region of the basin 40. The water level 64 in the riding floor, or to be more precise in the footing layer 18 thereof, may be regulated from below by way of these drainage tubes 44 in order in this way to adjust the moisture content of the footing layer 18 as required. As indicated in FIG. 8, the drainage tubes 44 are for example arranged within or outside the water-guiding support layer 20 of the riding floor.

Outside the usable area, and divided off by a dividing layer 48 of the floor, there is provided at least one water compensation device 52. The water compensation device 52 is constructed for example in the manner of a well and contains a water-receiving chamber 54 into the interior whereof, through the dividing layer 48, there project the drainage tubes 44. The water-receiving chamber 54 further includes for example a water inlet 56, a water outlet 58 with associated pump 60, and a water level sensor 62 for detecting the water level 64 in the water compensation device 52.

Because the drainage tubes 44 of the riding floor are connected to the interior of the water compensation device 52, the water level 64 in the water compensation device 52 is equal to the water level 64 in the riding floor. This means that the water level 64 in the riding floor can be adjusted automatically, by means of the water inlet 56 and the water outlet 58, by adjusting the water level 64 in the water compensation device 52, which is monitored by the water level sensor 62, to achieve the optimum adjustment of moisture content of the footing layer 18 of the riding floor. Depending on the application and environmental conditions of the footing layer 18, it is in this case possible to make differing adjustments to its moisture content.

In conclusion, and as a precautionary measure, it will be understood that the numerical values specified above are provided purely by way of example and serve to illustrate the invention. It goes without saying that within the scope of the present invention other numerical values, ranges of values and numerical combinations are also conceivable. It goes without saying that the same also applies to the materials listed above. Moreover, as a precautionary measure it is pointed out that none of the illustrations in FIGS. 1 to 8 are to scale, in order to allow the details of the ground preparation elements to be illustrated better.

The riding floor described above is—in particular as a result of the construction of the ground preparation elements with the tufts of bristles—specially suitable for Western riding, in which the horses (must) also slide over the floor in the various disciplines.

Although not illustrated, further variants on the riding floor according to the invention are also conceivable.

For example, in addition the entire surface of a ground preparation element 12 may be provided with a seal, in which case the connections between the ground preparation element 12 and the tufts of bristles 14 should each be sealed as well. In a preferred embodiment, this seal comprises a layer of Vaseline which is applied to the prefabricated ground preparation element 12 for example by a dip process. In this, the ground preparation element 12 is immersed underside first, with the tufts of bristles 14 already inserted, in the sealing fluid as far as the upper side but with the tufts of bristles 14 still projecting out so that sealing of the tufts of bristles 14 can be avoided.

This sealing technique is described in detail, for example, in German utility model application 20 2007 005 678.8, which is not a prior publication, whose content is incorporated herein in its entirety, and specifically with regard to its disclosure concerning the sealing. In addition to the advantages mentioned in the foregoing utility model application, the sealing layer in the present case also improves the storage of water on the upper side of the ground preparation elements 12.

It is further conceivable for the ground preparation elements 12 each to be provided with a marginal projection which extends along the entire margin of a ground preparation element 12 from the upper side thereof. The height of a marginal projection of this kind in this case corresponds at most to the length h14 of the tufts of bristles 14 projecting out of the ground preparation elements 12. Preferably, the height of the marginal projection is only approximately ½ to ⅔ of this reference size h14, with the result that the effect of the tufts of bristles 14 at the borders of the individual ground preparation elements 12 is retained.

A marginal projection of this kind may form a large pan, extending over the entire ground preparation element 12, for the storage of water on the upper side of a ground preparation element 12. The upper side of the ground preparation element 12 is of substantially planar construction apart from this marginal projection. In this way, it is possible for a riding floor having optimum properties to be prepared by optimized water management, in that the footing layer 18 is prevented from drying out too quickly and sufficiently rapid drainage of excess water is ensured.

Ground preparation elements having a marginal projection of this kind are described in detail in the above-mentioned, commonly assigned German utility model 20 2008 011 248 U1. The document is also incorporated by reference in its entirety, but especially with regard to the structure and mode of functioning of the marginal projection.

The invention claimed is:

1. A riding floor assembly, comprising:

a ground preparation layer formed of a plurality of substantially plate-shaped ground preparation elements to be laid next to one another on a subfloor;

a footing layer disposed on said ground preparation elements on an upper side thereof facing away from the subfloor, said footing layer being a fine-particle footing layer;

a plurality of tufts of bristles disposed on said ground preparation elements on the upper side thereof facing said footing layer, said plurality of tufts of bristles having a length selected such that said bristles do not project out of said footing layer.

2. The riding floor assembly according to claim 1, wherein the upper side of said ground preparation elements is formed with a plurality of recesses, said recesses having a depth that is smaller than a total length of said tufts of bristles and partly accommodating said tufts of bristles.

3. The riding floor assembly according to claim 2, wherein said tufts of bristles are mounted in said recesses by being inserted, clamped, pressed, driven, glued, and/or welded into said recesses.

4. The riding floor assembly according to claim 2, wherein said ground preparation elements have a given thickness, and a depth of said recesses is approximately 20% to 70% of said given thickness of said ground preparation elements.

5. The riding floor assembly according to claim 4, wherein said depth of said recesses is approximately 30% to 50% of said given thickness of said ground preparation elements.

6. The riding floor assembly according to claim 2, wherein said tufts of bristles have a given diameter, and a depth of said recesses is approximately 100-300% of said given diameter of said tufts of bristles.

7. The riding floor assembly according to claim 6, wherein said depth of said recesses is approximately 150-250% of said given diameter of said tufts of bristles.

8. The riding floor assembly according to claim 1, which comprises at least one mat element holding a plurality of said tufts of bristles disposed between said ground preparation layer and said footing layer.

9. The riding floor assembly according to claim 1, further comprising a water guidance layer disposed between said ground preparation layer and said footing layer, a height of said water guidance layer corresponding at most to a length of said tufts of bristles projecting out of said ground preparation elements.

10. The riding floor assembly according to claim 1, which comprises a water-guiding support layer to be disposed between the subfloor and said ground preparation layer, said support layer being formed of gravel and/or grit.

11. The riding floor assembly according to claim 1, wherein said footing layer is formed of fine-particle sand.

12. The riding floor assembly according to claim 1, wherein said ground preparation elements of said ground preparation layer are connected to one another with an interlocking tongue-and-groove system.

13. The riding floor assembly according to claim 12, wherein said tongue-and-groove system includes first and second extensions at a lateral periphery of said ground preparation elements and extending laterally, wherein a height of the first and second extensions in each case is smaller than a height of said ground preparation elements, and wherein the first and second extensions are disposed along the periphery and in a vertical direction of said ground preparation elements such that, when two ground preparation elements are placed adjacent one another, at least one first extension of one of said ground preparation elements and at least one second extension of the other said ground preparation element overlap one another in the vertical direction.

14. The riding floor assembly according to claim 1, wherein said ground preparation elements are formed with one or more projections integrally formed on an underside thereof facing the subfloor.

15. The riding floor assembly according to claim 1, wherein said ground preparation elements are made of a synthetic material.

16. The riding floor assembly according to claim 1, which comprises at least one drainage device disposed on a side of said ground preparation layer facing toward the subfloor.

17. The riding floor assembly according to claim 16, which comprises a water compensation device fluidically connected to said at least one drainage device, said water compensation device including a water-receiving chamber having a water inlet and/or a water outlet and being disposed laterally outside said ground preparation layer.

18. The riding floor assembly according to claim 17, which comprises a watertight basin containing the riding floor.

19. The riding floor assembly according to claim 1, wherein said fine-particle footing layer is formed of fine-particle sand or similar material.

20. A riding floor assembly, comprising:

a ground preparation layer formed of a plurality of substantially plate-shaped ground preparation elements to be laid next to one another on a subfloor;

a footing layer disposed on said ground preparation elements on an upper side thereof facing away from the subfloor;

a plurality of tufts of bristles disposed on said ground preparation elements on the upper side thereof facing said footing layer, said plurality of tufts of bristles having a length selected such that said bristles do not project out of said footing layer; and said ground preparation elements having a plurality of apertures formed therein and said tufts of bristles being guided through said apertures for projecting out of said upper side of said ground preparation elements facing toward said footing layer;

said tufts of bristles projecting out from, and being affixed to, an underside of said ground preparation elements facing the subfloor.

21. A riding floor assembly, comprising:

a ground preparation layer formed of a plurality of substantially plate-shaped ground preparation elements to be laid next to one another on a subfloor;

a footing layer disposed on said ground preparation elements on an upper side thereof facing away from the subfloor;

a plurality of tufts of bristles disposed on said ground preparation elements on the upper side thereof facing said footing layer, said plurality of tufts of bristles having a length selected such that said bristles do not project out of said footing layer; and a water guidance layer disposed between said ground preparation layer and said footing layer, a height of said water guidance layer corresponding at most to a length of said tufts of bristles projecting out of said ground preparation elements.

22. The riding floor assembly according to claim 21, wherein said water guidance layer is formed of a material selected from the group consisting of coarse-grain sand, gravel, grit, of mixtures thereof.

* * * * *